US006931667B2

(12) United States Patent
Kronenbeger

(10) Patent No.: US 6,931,667 B2
(45) Date of Patent: Aug. 23, 2005

(54) HEADWEAR PIECE WITH OBJECT HOLDING CAPABILITY

(76) Inventor: Ronald Kronenbeger, 320 Portwine Rd., Riverwoods, IL (US) 60015

( * ) Notice: Subject to any disclaimer, the term of this patent is extended or adjusted under 35 U.S.C. 154(b) by 0 days.

(21) Appl. No.: 10/420,259

(22) Filed: Apr. 22, 2003

(65) Prior Publication Data

US 2004/0210982 A1 Oct. 28, 2004

(51) Int. Cl.[7] ..... A42B 1/24
(52) U.S. Cl. ..... 2/209.13; 224/918
(58) Field of Search ..... 2/10, 12, 425, 2/209.13, 175.1, 195.1–195.5; 224/918

(56) References Cited

U.S. PATENT DOCUMENTS 5,113,529 A * 5/1992 Carr ..... 2/13
5,117,510 A * 6/1992 Broussard et al. ..... 2/209.3
5,734,993 A * 4/1998 D'Oca ..... 2/175.3
5,894,604 A * 4/1999 Crabb et al. ..... 2/209.13
6,237,159 B1 * 5/2001 Martin ..... 2/209.12
6,442,764 B1 * 9/2002 Badillo et al. ..... 2/209.13
6,671,885 B2 * 1/2004 Viggiano ..... 2/209.13

* cited by examiner

*Primary Examiner*—Katherine M Moran
(74) *Attorney, Agent, or Firm*—Wood, Phillips, Katz, Clark & Mortimer

(57) ABSTRACT

A headwear piece has a crown defining an opening to receive the head of a wearer. The crown has (a) an inside surface having at least a portion for engaging a wearer's head to maintain the headwear piece operatively situated on a wearers head and (b) an exposed external surface. The crown has first and second openings through the external surface of the crown and spaced from each other so that an elongate object can be directed through both of the first and second openings and frictionally maintained in a stored position on the crown with the headwear piece operatively situated on a wearer's head.

9 Claims, 3 Drawing Sheets

HEADWEAR PIECE WITH OBJECT HOLDING CAPABILITY

BACKGROUND OF THE INVENTION

1. Field of the Invention

This invention relates to headwear and, more particularly, to a headwear piece having openings strategically placed thereon to releasably hold objects as may be separated and used by a wearer.

2. Background Art

Many activities are engaged in which require the availability of small objects/accessories. As just one example, golfers utilize tees and scoring pencils repeatedly throughout a golf round. Several options are available to golfers to keep these items readily accessible.

One common practice is to place the tees and/or pencils in a user's pants or shirt pockets. However, pencil and tees have sharpened points which may cause discomfort, or in a worst case, injury, to the golfer.

To obviate this problem, many golf equipment suppliers have devised different systems to keep on hand, and readily accessible, a supply of golf tees and pencils. Golf bags are commonly equipped with external receptacles into which individual golf tees and pencils can be placed. Similarly, both manually operated and powered golf carts commonly have some structure to store tees and pencils near a score card for ready accessibility.

While the various systems, described above, adequately perform the function for which they are designed, they are inherently less effective than a system that would allow a golfer to keep the tees and pencil on his/her person. It is not uncommon for a golfer to walk ten to twenty yards from a cart to a golf tee, only to find that he/she has no tee available. To avoid this problem, some golfers improvise by placing the tees in either a tucked position between the upper ear and head, or wedged between part of a headwear piece and the head. The tees and pencils are prone to escaping when stored in this manner. At the same time, there is some discomfort associated with placement of the tees and pencils against the wearer's head.

Headwear pieces are often provided with receptacles to hold objects/accessories. It is known to modify conventional cloth caps/hats by sewing a strip of flexible material on the external surface thereof. As an example, a rectangular strip of cloth may have its ends secured to the headwear piece so that it is loosely bunched between the ends to define a receptacle into which an object/accessory can be pressed and frictionally maintained.

Formation of receptacles on the external surfaces of headwear pieces, while addressing a need, has a number of drawbacks. First of all, the cloth strip, or other addition to the external surface of the headwear piece, may detract significantly from the appearance thereof. Further, formation of the receptacle(s) may require the handling and separate installation of one or more relatively small elements, such as the strips. This may introduce another manufacturing step, representing added costs, inconvenience, and additional assembly time. Further, the combined thickness of the materials on the headwear piece and the receptacle defining structure may increase the overall thickness required to be sewn to the point that stitching operations are complicated.

Ideally, storage of small accessories on headwear is possible without increasing manufacturing complexity or cost to any significant degree and without appreciably altering the appearance of the headwear piece.

SUMMARY OF THE INVENTION

In one form, the invention is directed to a headwear piece having a crown defining an opening to receive the head of a wearer. The crown has (a) an inside surface having at least a portion for engaging a wearer's head to maintain the headwear piece operatively situated on the wearer's head and (b) an exposed external surface. The crown has first and second openings through the external surface of the crown and spaced from each other so that an elongate object can be directed through both of the first and second openings and frictionally maintained in a stored position on the crown with the headwear piece operatively situated on a wearer's head.

In one form, the first and second openings extend fully through the crown from the inside surface to the external surface.

In one form, the first opening is an elongate slit.

The first opening may be formed by a button hole machine.

In one form, the first and second openings are each formed as an elongate slit with a length.

The lengths of the first and second slits may extend substantially parallel to each other.

In one form, the first and second slits are spaced from each other by a distance not greater than 2 inches.

In one form, the crown is made from at least one cloth gore and the first opening is defined in the one cloth gore.

In one form, the one cloth gore has a fabric layer with a first surface that defines a part of the exposed external surface of the crown and the first opening extends through the first surface of the one cloth gore.

The first opening is bounded by an edge. In one form, edge stitching is performed on the crown around the edge.

The invention further contemplates the above headwear piece in combination with an object directed through both of the first and second openings and frictionally maintained in a stored position on the crown.

The invention is further directed to a headwear piece having a crown defining an opening to receive the head of a wearer and a brim/bill projecting from the crown. The headwear piece has an exposed external surface on the crown and extending continuously to the brim/bill. At least one of the crown and brim/bill has first and second openings through the external surface of the headwear piece and spaced from each other so that an elongate object can be directed through both of the first and second openings and frictionally maintained in a stored position on the headwear piece with the headwear piece operatively situated on a wearer's head.

In one form, the brim/bill has a thickness and the first and second openings extend fully through the thickness of the brim/bill.

The first opening may be an elongate slit.

In one form, the first opening is formed by a button hole machine.

In one form, the first and second openings are each an elongate slit with a length.

The lengths of the first and second slits may extend substantially parallel to each other.

In one form, the first and second slits are spaced from each other by a distance not greater than 2 inches.

The first opening is bounded by an edge. In one form, edge stitching is performed on the crown around the edge.

The invention further contemplates the above headwear piece in combination with an elongate object directed through both of the first and second openings and frictionally maintained in a stored position on the crown.

The invention is further directed to a method of storing an object on a headwear piece having a crown defining an opening to receive the head of a wearer and a brim/bill projecting away from the crown. The method includes the steps of: directing the object through first and second spaced openings in the headwear piece so that the object is frictionally maintained in a stored position on the headwear piece; and placing the headwear piece on a wearer's head.

The headwear piece may be placed on the wearer's head either before or after the object is placed in the stored position.

DETAILED DESCRIPTION OF THE DRAWINGS

Figure 1:
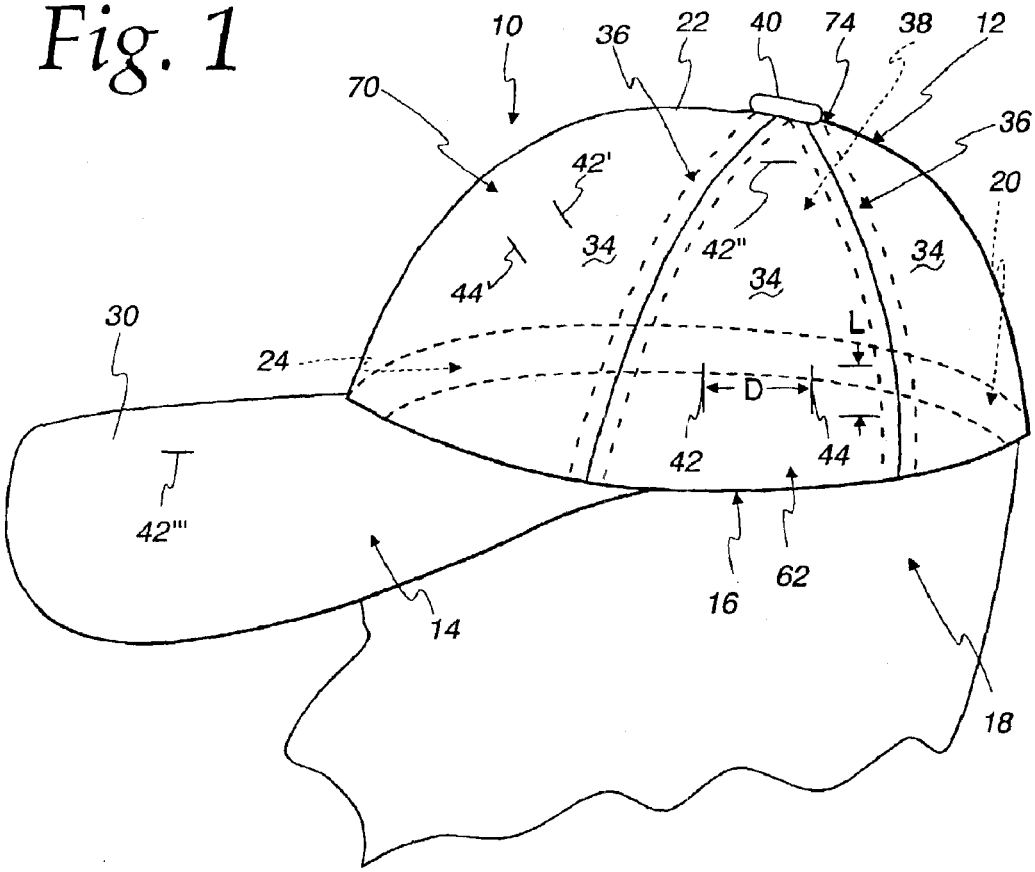
FIG. 1 is a perspective view of a headwear piece having paired openings for maintaining an object in a stored position thereon, according to the present invention.
Figure 2:
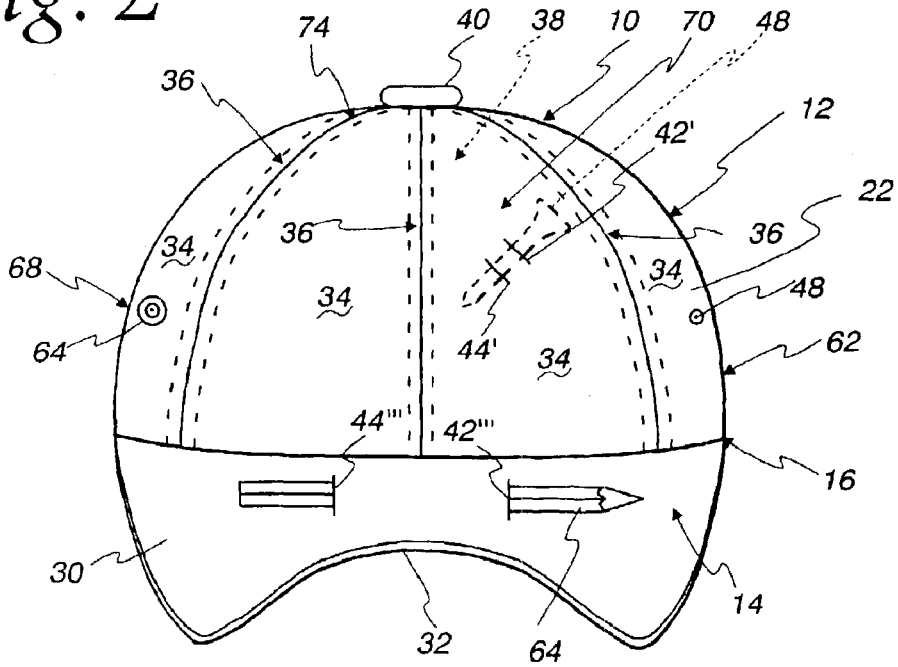
FIG. 2 is a front elevation view of the headwear piece in FIG. 1.

In FIGS. 1 and 2, one form of headwear piece, into which the present invention is incorporated, is shown at 10. The headwear piece 10 consists of a crown 12 and a brim/bill 14 connected to, and projecting angularly away from, the crown 12. The headwear piece 10 is conventionally referred to as a baseball-style cap. The crown 12 extends substantially continuously in an inverted cup shape, defining an opening 16 to receive the head of a wearer 18. The crown 12 has an internal surface 20 and an exposed external surface 22. The internal surface 20 includes a portion 24, around the entry to the opening 16, that embraces the wearer's head to maintain the headwear piece operatively situated on the wearer's head, as shown in FIG. 1. The exposed external surface 22 of the crown 12 extends continuously to exposed upwardly facing and downwardly facing surfaces 30, 32, respectively, on the brim/bill 14.

The crown 12 is defined by a plurality of cloth gores 34, each having a generally triangular configuration and joined edge-to-edge at sewn seams 36 to produce a closed, cup-shaped receptacle at 38 into which the wearer's head can be directed. The top of the crown 12 has a button 40 attached thereto. The brim/bill 14 is conventionally united to the crown 12 through a sewing process.

While the headwear piece 10 is described as being formed from cloth material, the crown 12 and/or the brim/bill 14 can be made from a different material or a combination of cloth and other materials. So long as certain portions of the headwear piece 10 can function as described below, the nature of the material remains insignificant.

Figure 3:
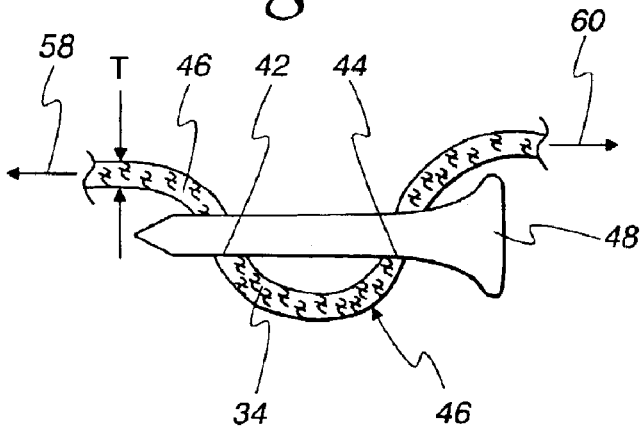
FIG. 3 is an enlarged, fragmentary, cross-sectional view of a side of the headwear piece in FIGS. 1 and 2 and showing an object/golf tee directed therethrough and maintained in a stored position on the headwear piece.
Figure 4:
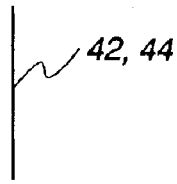
FIG. 4 is an enlarged, elevation view of one of the openings shown in FIGS. 1–3.
Figure 5:
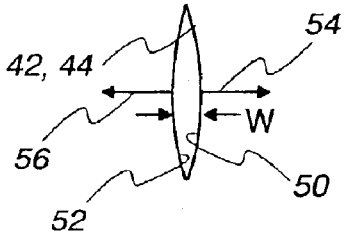
FIG. 5 is a view as in FIG. 4 with the opening widened as occurs when an object is directed therethrough.

According to the invention, paired, first and second openings 42,44 are formed through the external surface 22 of the crown 12 and preferably through the full thickness T of the cloth layer 46 defining the gores 34, as shown in detail in FIGS. 3–5, taken in conjunction with FIGS. 1 and 2. The openings 42,44 are each in the form of an elongate slit having a length L (FIG. 1) as dictated by the particular object that is intended to be directed therethrough. In FIGS. 2 and 3, an exemplary golf tee 48 is shown for the object to be held by the headwear piece 10. The slits 42,44 may have the same or a different length L. As just an example, the length L of each slit 42, 44 may be the same and on the order of ⅛ to ½, of course depending upon the dimension of the object to be directed therethrough.

The openings/slits 42, 44 can actually be made with a more substantial length L to accommodate a wide range of object sizes. For example, the length L of the slits 42,44 can be made conceivably as long as 2 inches, or greater. While the invention would function, the gripping capability for smaller objects would not be as great.

The spacing between the slits 42, 44 is typically less than 2 inches for the type of objects typically contemplated to be held by the headwear piece 10 having the style shown.

According to the invention, the object, in this case the golf tee 48, is directed through one slit 44 from the outside in and through the other slit 42 through the inside out. With the slits 42, 44 extending fully through the gores 34, the object becomes exposed directly to the wearer's head. This can be facilitated by slightly bunching the layer 46 between the slits 42,44, as shown in FIG. 3. As the object is moved into and through the slits 42, 44, the width W of the slits 42,44 is increased under a force that is applied to opposite edges 50,52, bounding the slits 42,44 by the object/golf tee 48. That is, the object/golf tee 48 produces a wedging action on the edges 50,52 and urges the same oppositely, as indicated by the arrows 54,56 to develop a passageway through which the object/golf tee 48 can be pressed. With no object extending into the slits 42, 44, the slits 42, 44 are substantially closed.

Once the object/golf tee 48 is in the FIG. 3 position, the cloth in the layer 46 on opposite sides of the openings 42,44, can be drawn in opposite directions, as indicated by the arrows 58,60, as a result of which the width W of the openings 42,44 constricts to positively, frictionally squeeze/grip the object/golf tee 48. This action occurs automatically as the headwear piece 10 is directed over the wearer's head and the opening 16 enlarged. However, the object/golf tee 48 could be placed into the stored position with the headwear piece 10 already operatively placed on the wearer's head.

It should also be understood that the object/golf tee 48 can be inserted without bunching the cloth in the layer 46 as shown in FIG. 3. The object/golf tee 48 can be pressed through the openings 42,44, as by maneuvering the object/golf tee 48 in a sewing movement through the openings 42, 44, which is made possible by the stretching of the fabric in the layer 46 and expansion of the width W of the openings 42,44.

The slits 42,44 are shown in FIGS. 1–3 at one side 62 of the headwear piece 10 and with the lengths L extending generally in a vertical direction. The invention contemplates that other locations and orientations of the openings 42,44 could be used, as virtually anywhere, and in virtually any orientation, on the crown 12. For example, a pencil 64 is shown mounted using the invention in a similar manner on the side 68 of the headwear piece 10 opposite to the side 62.

As further shown in FIG. 1, openings 42',44' are shown angularly disposed on a gore 34 at the front region 70 of the crown 12. In FIG. 2, the object/golf tee 48 is shown in phantom frictionally maintained in a stored position on the crown 12 by passage through the slits 42',44'.

Figure 6:
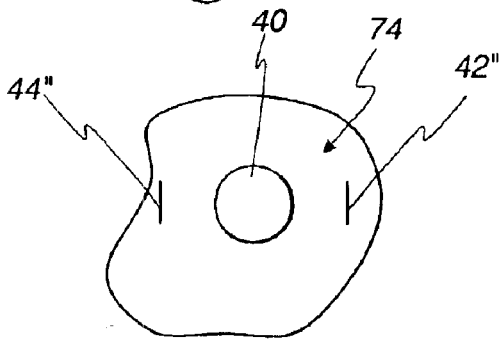
FIG. 6 is a fragmentary, plan view of a top portion of the headwear piece in FIGS. 1 and 2 with paired slits formed thereon according to the invention.

As an alternative location, as shown in FIGS. 1 and 6, openings 42",44" can be provided at the top 74 of the crown 12 so that the stored object passed through the openings 42",44" extends beneath the button 40.

As an alternative to the crown location, openings 42'",44'" can be provided in the brim/bill 14. As one preferred location thereon, the slits 42'",44'" are located in a central region which has a natural curvature which facilitates passage through of an object, in this case shown as the pencil 64. Generally, the same principal of operation is utilized, however the brim/bill 14 typically has a substantially more rigid construction than that provided by the material defining the crown 12.

Figure 7:
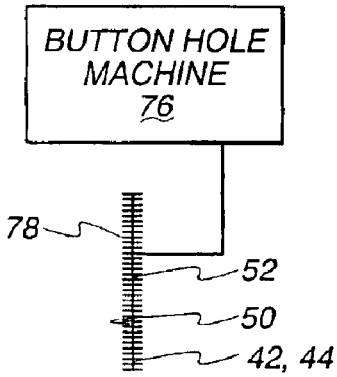
FIG. 7 is a view as in FIG. 4 and showing a button hole machine in schematic form stitching around the edges of the opening in FIGS. 4 and 5.
Figure 8:
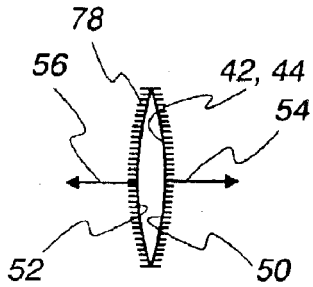
FIG. 8 is a view as in FIG. 7 with the edges spread apart to widen the opening, as in FIG. 5.

To facilitate the formation of the openings 42,44, the openings 42,44 can be formed by a conventional button hole machine, shown schematically at 76 in FIGS. 7 and 8. The button hole machine 76 can form the openings 42,44 and edge stitching 78 continuously around the edge portions 50,52 to maintain the integrity thereof and avoid edge fraying.

Figure 9:
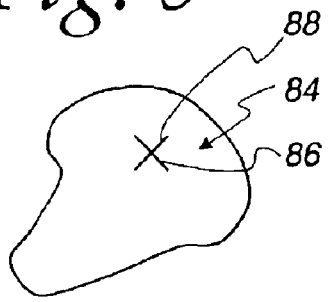
FIG. 9 is a fragmentary, elevation view of a portion of a headwear piece with a modified form of opening configuration, according to the invention, therein.

The invention also contemplates that other than a straight slit configuration can be used for the openings 42,44. In FIG. 9, one of the openings 84, corresponding in function to the openings 42,44, is shown defined by crossing cuts 86,88. Other structures, such as cutouts, and the like, with different configurations than shown could be used consistent with the invention.

Figure 10:
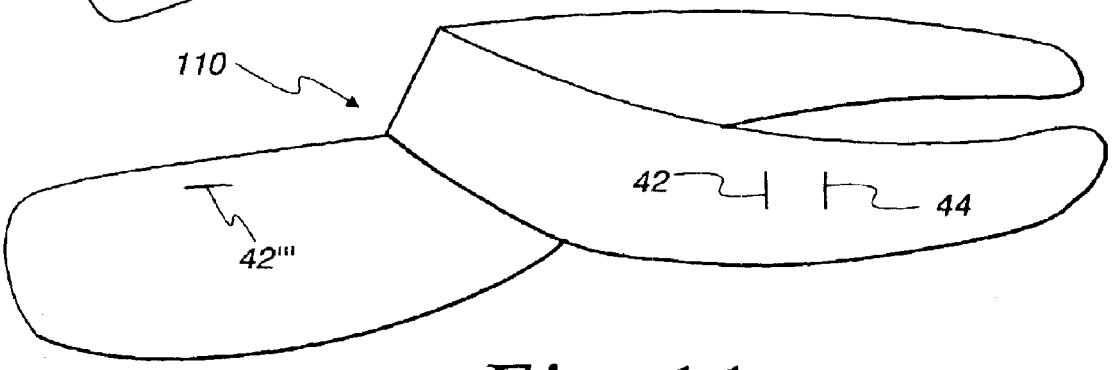
FIG. 10 is a perspective view of another form of headwear piece, in the form of a visor, and into which the present invention is incorporated.
Figure 11:
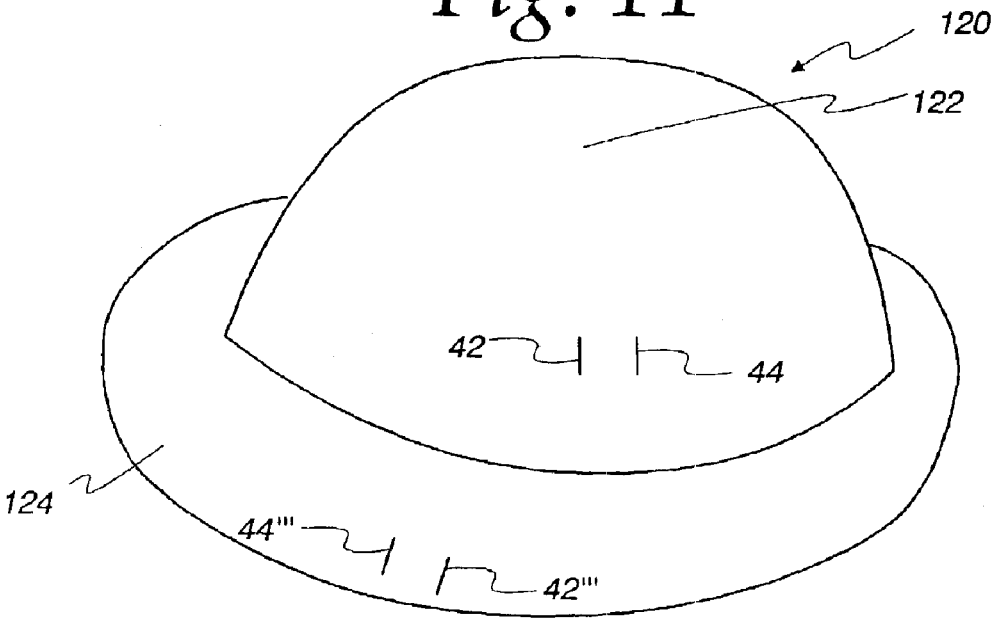
FIG. 11 is a perspective view of a still further form of headwear piece having a continuous, peripheral brim, and into which the present invention is incorporated.

The invention also contemplates incorporation into other types of headwear pieces such as a visor, as shown at 110 in FIG. 10, and a headwear piece at 120 in FIG. 11, consisting of a cup-shaped crown 122 and a brim 124 which extends around the full periphery of the crown 122. The slits 42,44,42'",44'" are provided and function in the same manner as previously described.

Figure 12:
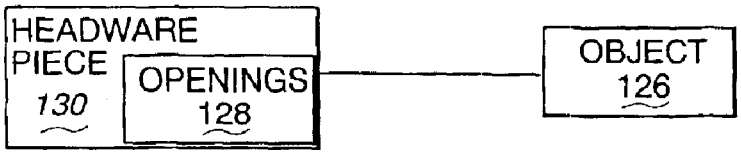
FIG. 12 is a schematic representation of the combination of a headwear piece, according to the present invention, and an object which is maintained in a stored position thereon.

As shown in FIG. 12, the invention contemplates the placement of any object, shown generically at 126 in FIG. 12, through openings 128 in a headwear piece 130, regardless of shape or location, and regardless of the type of headwear piece 130, including configurations not shown in the drawings herein.

While the invention has been described with particular reference to the drawings, it should be understood that various modifications could be made without departing from the spirit and scope of the present invention.

What is claimed is:

1. In combination:

a) a headwear piece comprising:

a crown defining an opening to receive the head of a wearer, a brim/bill projecting angularly away from the crown, the crown comprising i) an inside surface having at least a portion for engaging a wearer's head to maintain the headwear piece operatively situated on a wearer's head and ii) an exposed external surface, the crown having first and second adjacent openings through the external surface of the crown both at a first location on the crown and spaced from each other so that an elongate object can be directed into and through one of the first and second openings and through and from the other of the first and second openings to thereby be frictionally maintained in a stored position on the crown and directly against the crown between the first and second adjacent openings with the headwear piece operatively situated on a wearer's head, wherein each of the first and second openings is an elongate, substantially closed slit that can be opened and widened to allow direction therethrough of an object; and b) an object that is directed through the first and second adjacent openings and maintained in a stored position on the headwear piece when the headwear piece is operatively situated on a wearer's head solely by frictional forces generated between the crown and object at the first location, which frictional forces are increased as the headwear piece is placed on a wearer's head and the crown is drawn in opposite directions at the first location.

2. The combination according to claim 1 wherein the first and second openings extend fully through the crown from the inside surface to the external surface.

3. The combination according to claim 1 wherein the first opening is formed by a button hole machine.

4. The combination according to claim 1 wherein the lengths of the first and second openings extend substantially parallel to each other.

5. The combination according to claim 1 wherein the first and second openings are spaced from each other by a distance not greater than 2 inches.

6. The combination according to claim 1 wherein the crown comprises at least one cloth gore and the first opening is defined in the one cloth gore.

7. The combination according to claim 6 wherein the one cloth gore has a fabric layer with a first surface that defines a part of the exposed external surface of the crown and the first opening extends through the first surface of the one cloth gore.

8. The combination according to claim 1 wherein the object comprises an elongate golf accessory directed through both of the first and second openings.

9. The combination according to claim 1 wherein a part of the object in the stored position is exposed directly to the wearer's head.

* * * * *